US005829904A

United States Patent [19]

Matsumoto et al.

[11] Patent Number: 5,829,904

[45] Date of Patent: Nov. 3, 1998

[54] WRITING IMPLEMENT INK CONDUCTING CORE

[75] Inventors: Kazuaki Matsumoto; Motohiro Komiya, both of Yokohama; Jun Hosoya, Fujioka, all of Japan

[73] Assignee: Mitsubishi Pencil Kabushiki Kaisha, Tokyo, Japan

[21] Appl. No.: 397,786

[22] Filed: Mar. 3, 1995

[30] Foreign Application Priority Data

| | | | |
|---|---|---|---|
| Mar. 16, 1994 | [JP] | Japan | 6-070167 |
| Aug. 9, 1994 | [JP] | Japan | 6-206141 |

[51] Int. Cl.[6] ..... B43K 7/10; B43K 8/06; B43K 8/08

[52] U.S. Cl. ..... 401/209; 401/199

[58] Field of Search ..... 401/198, 199, 401/209

[56] References Cited

U.S. PATENT DOCUMENTS

| | | | |
|---|---|---|---|
| 3,003,181 | 10/1961 | Rosenthal | 401/199 |
| 3,402,008 | 9/1968 | Green | 401/199 |
| 3,951,555 | 4/1976 | Wittnebert et al. | 401/199 X |
| 4,145,148 | 3/1979 | Fukuoka | 401/209 |
| 4,645,367 | 2/1987 | Mutschler | 401/199 |
| 4,712,937 | 12/1987 | Schmidt et al. | 401/209 X |
| 5,286,127 | 2/1994 | Scholz | 401/199 |

FOREIGN PATENT DOCUMENTS

| | | | |
|---|---|---|---|
| 256615 | 2/1988 | European Pat. Off. | 401/209 |
| 1454400 | 8/1966 | France | 401/199 |
| 2 569 615 | 4/1985 | France . | |
| 5208582 | 8/1993 | Japan | 401/199 |

*Primary Examiner*—Steven A. Bratlie
*Attorney, Agent, or Firm*—Darby & Darby

[57] ABSTRACT

An ink conducting core for supplying ink from an ink container to a pen point is formed with an exposing recess in the vicinity of a connecting portion of the ink conducting core with a middle core. With this, even when outside impact etc. causes air bubbles to enter the ink conducting core, the bubbles may be ejected readily through the exposing recess whereby smooth ink supply can be secured all the time. An annular groove and a small diameter portion is provided in the rear part of an ink conducting core. An ink retainer having a through-hole through which the ink conducting core is fitted is constructed such that the through-hole has a small diameter portion in the rear end thereof. The ink conducting core is fitted to the ink retainer with the side walls of the annular groove engaging the small diameter portion in the rear end of the through-hole. As a result, it is possible to securely restrict back-and-forth movement of the ink conducting core due to impact etc.

11 Claims, 4 Drawing Sheets

WRITING IMPLEMENT INK CONDUCTING CORE

BACKGROUND OF THE INVENTION (1) Field of the Invention

The present invention relates to a writing implement having an ink container for directly storing ink as a liquid without using sponge-like material or fibers etc. as an absorptive material and provided with an ink retainer which temporarily holds the ink pushed out from the ink container as air inside the ink container expands with a temperature rise or other causes in order to prevent ink from dropping through its pen point and/or vent. The present invention relates, in particular, to an improvement of an ink conducting core for allowing ink to flow out from the ink container to the pen point.

(2) Description of the Prior Art

In a conventional writing implement of a direct ink storing type, the arrangement for allowing ink to flow out from its ink container to a pen point is constructed such that an ink conducting core as a result of an ink flow passage is press-fitted at its one end into a through-hole of an ink retainer and the other end of the core, if it has a flat end, is abutted against a middle core composed of a bundle of fibers attached to the rear end of the pen point or if it is cone-shaped, is pressed into the middle core. With this arrangement, the ink is supplied from the ink container by way of the ink conducting core to the middle core whereby the ink is supplied to flow out from the pen point.

When an impact force, etc. hits the writing implement of the conventional direct ink storing type, ink in the ink flow passage of the ink conducting core comes out from one end and a bubble enters the ink flow passage. In this situation, if the end portion on the ink container side of the ink conducting core is placed in contact with the ink stored so that ink may be re-filled to the middle core, the capillary force of the ink conducting core attracts ink into the ink flow passage of the ink conducting core. The bubble inside the ink flow passage is conveyed to the connecting portion with the middle core by the ink thus taken in, but cannot enter the middle core because ink remaining inside the fiber bundle of the middle core forms a blocking barrier which disturbs the bubble to be ejected from the ink passage. The bubble stands in the way between the ink conducting core and the middle core, and causes a failure in supplying ink from the ink conducting core to the middle core bringing about a deficiency in writing capability.

In the conventional writing implement of the direct storing type, since the ink conducting core is press-fitted into the ink retainer, if impact etc. strikes the writing implement, this may cause the ink conducting core to move. Backward movement of the ink conducting core breaks up the joint between the ink conducting core and the middle core therefore interfering with the supply of ink to the middle core. Forward movement of the ink conducting core pushes the middle core forward so that the front end of the middle core comes in contact with the tip ball. This disturbs the rolling of the ball, and/or makes the ink flow channel between the ball and the middle core narrow lowering the ink supply to the ball. On the other hand, if the fitting of the ink conducting core to the through-hole of the ink retainer is enhanced in order to prevent the movement of the ink conducting core, the through-hole of the ink retainer may crack. Moreover, since the ink retainer and the ink conducting core, in general, are molded of resin, the press-fitting force between these elements, even if it is fixed rigidly, tends to be weakened with the passage of time due to the creep phenomenon. Therefore, it has been impossible to enhance the press-fitting force stronger than a certain level.

SUMMARY OF THE INVENTION

It is therefore an object of the present invention to provide a writing implement having an ink conducting core which allows air bubbles inside an ink flow passage of the ink conducting core to be easily released outside to be able to attain smooth ink supply to a middle core.

It is another object of the present invention to provide a writing implement having an ink conducting core capable of allowing smooth ink supply to a pen point even if the writing implement is hit by impact forces which would cause the ink conducting core to move.

In accordance with a first aspect of the present invention, there is provided a writing implement including:

a barrel cylinder having an ink container for directly storing ink in the rear part thereof;

an ink retainer attached in the front part of the barrel cylinder and having a through-hole provided substantially coaxially in the center thereof, a plurality of circular grooves on the outer periphery thereof for retaining ink and a longitudinal flute communicating between these circular grooves;

a middle core composed of a bundle of fibers and connected to the rear part of a pen point; and an ink conducting core fitted to the through-hole of the ink retainer and having an ink flow passage thereinside which communicates the rear part of the middle core with the ink container, so that ink is conducted through the ink flow passage from the ink container to the middle core, and constructed such that the ink conducting core is further formed with an exposing recess for exposing the ink flow passage to the outside of the ink conducting core in the vicinity of the connecting portion of the ink conducting core with the middle core so that air bubbles staying inside the ink flow passage can be allowed to be ejected outside the ink flow passage.

In accordance with a second aspect of the present invention, there is provided a writing implement including:

a barrel cylinder having an ink container for directly storing ink in the rear part thereof;

an ink retainer attached in the front part of the barrel cylinder and having a through-hole provided substantially coaxially in the center thereof, a plurality of circular grooves on the outer periphery thereof for retaining ink and a longitudinal flute communicating between these circular grooves;

a middle core composed of a bundle of fibers and connected to the rear part of a pen point; and an ink conducting core fitted to the through-hole of the ink retainer and having an ink flow passage thereinside which communicates the rear part of the middle core with the ink container, so that ink is conducted through the ink flow passage from the ink container to the middle core, and constructed such that the through-hole of the ink retainer is formed in the rear end thereof with a small diameter portion and the ink conducting core is formed in the rear part thereof with an annular groove and a small diameter portion, so that when a front side wall defining the annular groove is abutted against a stepped portion defined by the small diameter portion of the through-hole of the ink retainer, backward movement of the ink conducting core is restricted, while when a rear side wall defined by the small diameter portion of the ink conducting core and the annular groove is abutted against the rear face of the small diameter portion of the through-hole, forward movement of the ink conducting core is restricted.

In accordance with a third aspect of the present invention, there is provided a writing implement including:

a barrel cylinder having an ink container for directly storing ink in the rear part thereof;

an ink retainer attached in the front part of the barrel cylinder and having a through-hole provided substantially coaxially in the center thereof, a plurality of circular grooves on the outer periphery thereof for retaining ink and a longitudinal flute communicating between these circular grooves;

a middle core composed of a bundle of fibers and connected to the rear part of a pen point; and an ink conducting core fitted to the through-hole of the ink retainer and having an ink flow passage thereinside which communicates the rear part of the middle core with the ink container, so that ink is conducted through the ink flow passage from the ink container to the middle core, and constructed such that the ink conducting core is formed with an exposing recess for exposing the ink flow passage to the outside of the ink conducting core in the vicinity of the connecting portion of the ink conducting core with the middle core so that air bubbles staying inside the ink flow passage can be allowed to be ejected outside the ink flow passage, and the through-hole of the ink retainer is formed in the rear end thereof with a small diameter portion and the ink conducting core is formed in the rear part thereof with an annular groove and a small diameter portion, so that when a front side wall defining the annular groove is abutted against a stepped portion defined by the small diameter portion of the through-hole of the ink retainer, backward movement of the ink conducting core is restricted, while when a rear side wall defined by the small diameter portion of the ink conducting core and the annular groove is abutted against the rear face of the small diameter portion of the through-hole, forward movement of the ink conducting core is restricted.

DESCRIPTION OF THE PREFERRED EMBODIMENTS

Figure 1:
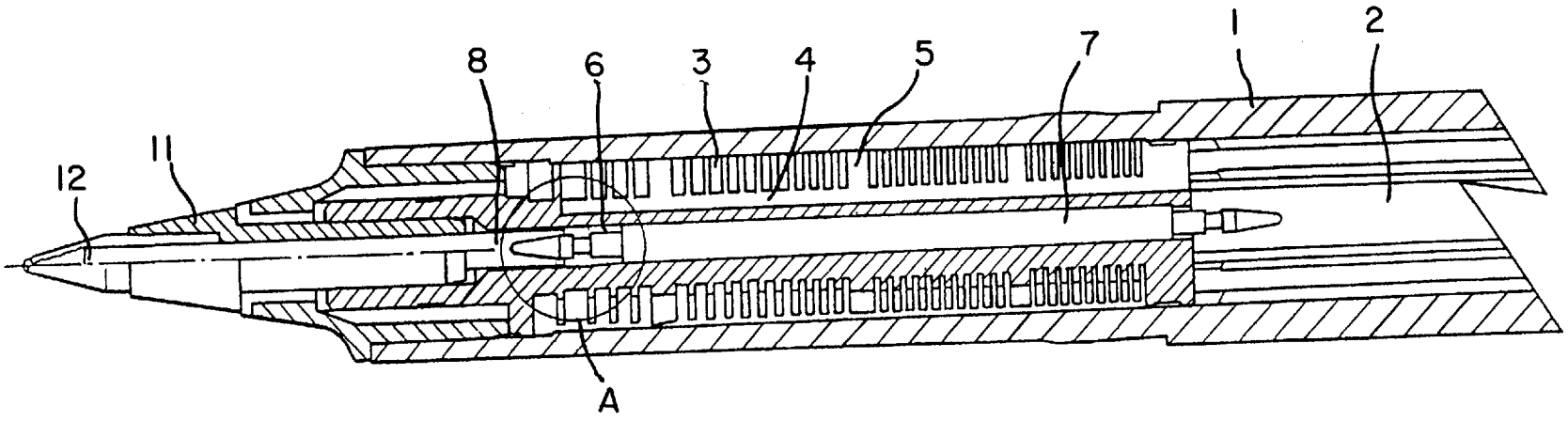
FIG. 1 is a partial longitudinal sectional view showing an embodiment of a writing implement in accordance with the present invention.

FIG. 1 shows an embodiment of the present invention, and the embodiment will be detailed with reference to FIG. 1. A main body of a writing implement of the present invention is composed of a barrel cylinder 1 having an ink container 2 at the rear end thereof. In the front part of the cylinder 1, an ink retainer 5 is provided which has a plurality of circular grooves 3 on the outer periphery thereof for retaining ink and a longitudinal flute 4 communicating between these circular grooves 3. A through-hole 6 is axially bored through the center of the ink retainer 5, and an ink conducting core 7 is fitted through the through-hole 6. The forward end of the ink conducting core 7 abuts or pierces a middle core 8, which in turn is connected at its front end to a pen point 12. In this arrangement, ink from the ink container 2 passes through the ink conducting core 7 and the middle core 8, and finally reaches the pen point 12. The pen point 12 is supported by a pen point supporter 11.

Figure 2:
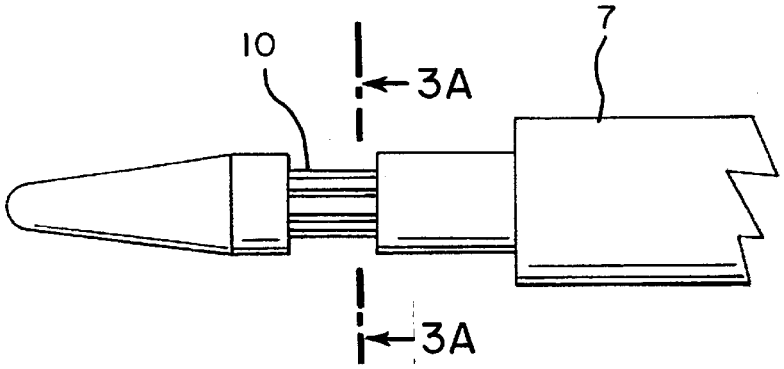
FIG. 2 is an enlarged view of a front end portion of an ink conducting core designated by a circle A in FIG. 1.
Figure 3A:
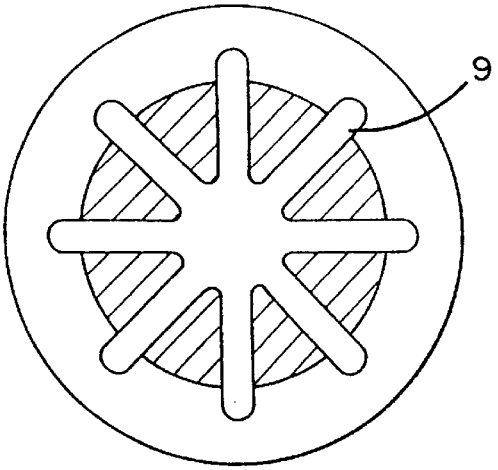
FIG. 3A is a sectional view of the ink conducting core taken along line 3A—3A in FIG. 2.
Figure 3B:
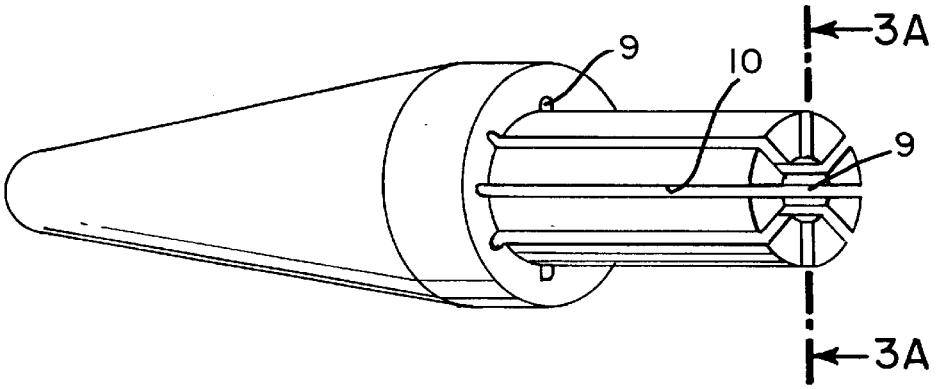
FIG. 3B is a partial perspective view of the ink conducting core taken along line 3A—3A in FIG. 2.

The ink conducting core 7 is a rod-like member and has a cone-shaped front end as shown in FIG. 2 for allowing the core 7 to easily pierce into the middle core 8 to secure the connection between the cores 7 and 8 and establish stabilized flow of ink to the core 8. The rear end of the ink conducting core 7 is conically shaped as well so as to secure easy suction of ink. FIG. 3A shows a section of the ink conducting core 7 taken along line B—B in FIG. 2, and FIG. 3B shows a perspective view of the ink conducting core 7 taken along line B—B in FIG. 2. As seen in the sectional and perspective views, the ink conducting core 7 is provided with an ink flow passage 9 made of a resin by extrusion-molding and composed of capillaries extending outward in substantially radial directions. An exposing recess 10 is formed behind the conical part of the ink conducting core 7 in such a manner that the ink flow passage 9 may be exposed to the outside partly or as whole on the peripheral side of the exposing recess 10.

Now, if the main body of the writing implement is impacted in its axial direction, ink inside the ink flow passage 9 of the ink conducting core 7 comes out from its rear end, and instead the equivalent volume of air enters as a bubble enters the ink flow passage 9 of the ink conducting core 7. In this situation, when further ink enters the ink conducting core 7 from the rear end thereof, the bubble inside the ink flow passage 9 is moved forward. In a conventional configuration in which no exposing recess 10 is equipped in the front end of the ink conducting core 7, the bubble moves to the contacting interface between the conical front face of the ink conducting core 7 and the middle core 8, but is not discharged into the outside of the middle core 8 because the path is blocked by ink remaining among fibers of the middle core 8. Accordingly, the bubble stands in the way at the contacting interface and ink does not flow smoothly from the ink conducting core 7 to the middle core 8, whereby ink supply for the pen point 12 decreases, causing starving or skipping in writing.

On the other hand, since, in the writing implement of the present invention having the structure described above, the ink flow passage 9 of the ink conducting core 7 is exposed to the outside through the exposing recess 10 in the vicinity of the connecting portion of the ink conducting core 7 with the middle core 8, the bubble pushed from the backside is released through the exposed portion and therefore no more blocking due to air-bubbles occurs the portion of the ink conducting core 7 that is connected to the middle core 8. As a result, ink can smoothly be supplied to the middle core 8, and no more starving or skipping in writing occurs.

Therefore, even when the writing implement of the present invention is impacted and bubbles enter the ink flow passage of the ink conducting core, the bubble inside the ink flow passage of the ink conducting core is pushed by the ink head and discharged outside since the recess exposing the ink flow passage to the outside is provided in the vicinity of the connecting portion of the ink conducting core with the middle core. Hence, no bubble will stand in the connecting portion of the ink conducting core with the middle core and it is, therefore, possible to establish smooth supply of ink to the middle core. Consequently, it is possible to keep the writing implement writing with good quality all the time.

Figure 4:
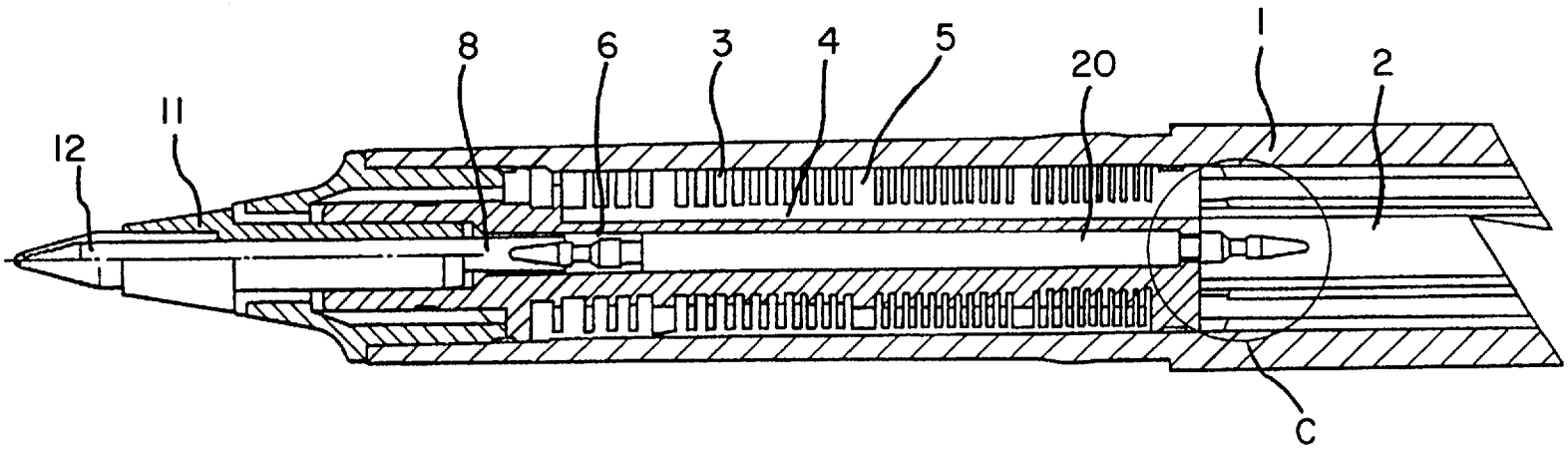
FIG. 4 is a partial longitudinal sectional view showing another embodiment of a writing implement in accordance with the present invention.
Figure 5:
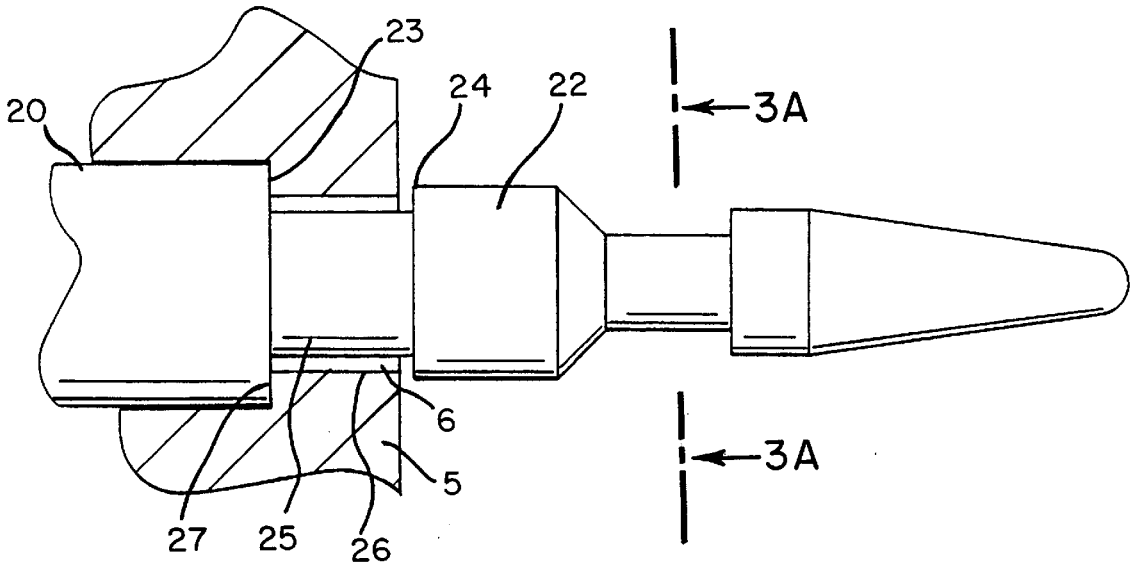
FIG. 5 is an enlarged view showing a rear end portion of an ink conducting core designated by a circle C in FIG. 4.

FIG. 4 shows another embodiment of the present invention. Here, description of components equivalent to those in the preceding embodiment will not be repeated. The configuration of the writing implement of this embodiment is basically the same as that of the preceding embodiment, but is characterized by a structure of an end portion of an ink conducting core 20 as shown in FIGS. 4 and 5. The ink conducting core 20 also has the same ink flow passage 9 inside, as shown in FIG. 3, having capillaries extending outward in substantially radial directions, and the section of the ink conducting core 20 taken on a line 3A—3A in FIG. 5 is the same as shown in FIG. 3.

The ink conducting core 20 has a conically shaped front end so that it may easily pierce into the middle core 8 to secure the connection with the middle core 8 and establish stabilized flow of ink to the core 8. The rear end of the ink conducting core 20 is formed as shown in FIG. 5 with an annular groove 25 and a small diameter portion 22. A front side wall 23 of the annular groove 25 abuts a stepped portion 27 formed by a small diameter portion 26 defining a through-hole 6 of an ink retainer 5 whereby backward movement of the ink conducting core 20 is constrained. A rear side wall 24 defined by the small diameter portion 22 and the annular groove 25 of the ink conducting core 20 abuts the rear side of the small diameter portion 26 of the through-hole 6 whereby forward movement of the ink conducting core 20 is restricted. In this case, the small diameter portion 22 of the ink conducting core 20 is slightly greater in diameter (by about 0.01 to 0.2 mm, than the small diameter portion 26 of the ink retainer 5. The diameter of the annular groove 25 is smaller than that of the small diameter portion 26 of the ink retainer 5. The groove width of the annular groove 25 in the axial direction is formed equal to or slightly greater than the length in the axial direction of the small diameter portion 26 of the ink retainer 5 (by about 0.1 to 0.5 mm). Here, when the width of the annular groove 25 in the axial direction is greater than the length in the axial direction of the small diameter portion 26 of the through-hole 6, impact force, if acted, moves the ink conducting core 20 forward by the differential distance between the width of the annular groove 25 and the length of the small diameter portion 26. Nevertheless, the distance is so small as mentioned above that the movement of the core 20 can be absorbed by the middle core 8 and will not cause the middle core 8 to move. Next, in the attachment of the ink conducting core 20 to the ink retainer 5, the rear end of the ink conducting core 20 is inserted from the front side of the ink retainer 5 in such a manner that the small diameter portion 22 of the ink conducting core 20 is forced to penetrate through the small diameter portion 26 of the through-hole 6. In this attachment, both the small diameter portions 22 and 26 are resiliently deformed to allow the former to penetrate through the latter. As the front side wall 23 of the annular groove 25 of the ink conducting core 20 abuts the stepped portion 27 of the through-hole 6, the ink conducting core 20 is attached in place relative to the ink retainer 5. Here, the difference between the diameter of the main part of the ink conducting core 20 and that of the small diameter portion 26 of the through-hole 6 is formed sufficiently greater (at least two times or more) than the difference between the diameter of the small diameter portion 22 of the ink conducting core 20 and that of the small diameter portion 26 of the through-hole 6.

When the thus constructed writing implement of the present invention is hit by impact which would cause the ink conducting core 20 to move backwards, the front side wall 23 of the annular groove 25 of the ink conducting core 20 abuts the stepped portion 27 formed on the small diameter portion 26 of the through-hole 6 of the ink retainer 5 whereby the backward movement is restricted. When the writing implement is hit by impact which would cause the ink conducting core 20 to move forward, the rear side wall 24 of the ink conducting core 20 abuts the rear face of the small diameter portion 26 of the ink retainer 5, so that it is possible to securely stop the forward movement of the core 20 relative to the ink retainer 5.

Figure 6:
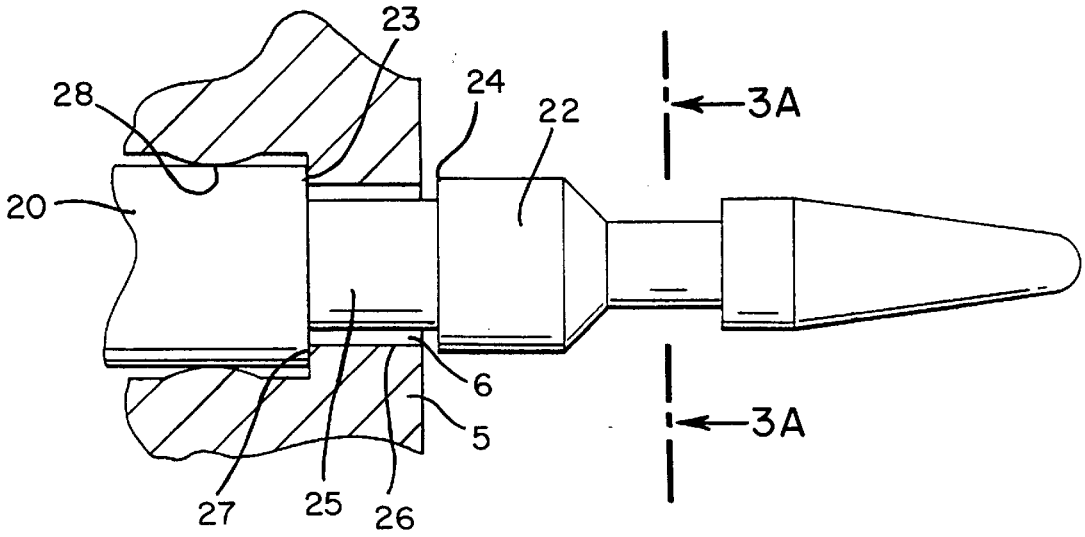
FIG. 6 is an enlarged view showing another embodiment of a rear end portion of an ink conducting core designated by a circle C in FIG. 4.

In addition to the above-mentioned arrangement, a required number of projecting parts or a peripheral projecting part 28 may be formed on the inner periphery of the ink retainer 5 as shown in FIG. 6. Thus, when the ink conducting core 20 is inserted into the ink retainer 5 through the through-hole 6 in the same manner as described above, the backward or forward movement of the ink conducting core 20 can be restricted more effectively due to the projecting part 28 formed inside the ink retainer 5.

To sum up, if impact etc. which could cause the ink conducting core to move, strikes the writing implement of the present invention, the ink conducting core can securely be held so as to maintain stabilized connection between the ink conducting core and the middle core. This establishes smooth supply of ink to the pen point and it is therefore possible to keep the writing implement in good quality all the time.

In the above description of the embodiments, although the writing implement having an ink conducting core with a bubble-ejecting means was described independently from that having an ink conducting core with a position-stabilizing means, it is possible to form a writing implement having both means. Specifically, it is possible to construct a writing implement including: an ink conducting core which has an exposing recess in the vicinity of the connecting portion of the ink conducting core with a middle core for ejecting bubbles staying in the ink flow passage and has an annular groove and a small diameter portion in the rear part thereof; and an ink retainer having a through-hole which has a small diameter portion in its rear part, wherein the ink conducting core is attached to the ink retainer in such a manner that the side walls of the annular groove engage the small diameter portion of the through-hole in order to prevent back-and-forth movement of the ink conducting core.

What is claimed is:

1. A writing implement comprising:

a barrel cylinder having an ink container for directly storing ink in the rear part thereof;

an ink retainer attached in the front part of said barrel cylinder and having a through-hole provided substantially coaxially in the center thereof, a plurality of circular grooves on the outer periphery thereof for retaining ink and a longitudinal flute communicating between said circular grooves;

a middle core composed of a bundle of fibers and connected to the rear part of a pen point; and an ink conducting core fitted to said through-hole of said ink retainer and having an ink flow passage longitudinally extending thereinside and which communicates the rear part of said middle core with said ink container, so that ink is conducted through said ink flow passage from said ink container to said middle core;

wherein:

said ink conducting core is further formed with an exposing recess for exposing said ink flow passage to the outside of said ink conducting core in the vicinity of the connecting portion of said ink conducting core with said middle core so that air bubbles within said ink flow passage are ejectable to the outside of said ink flow passage; and said ink flow passage is an internal passage contained within said ink conducting core and is only exposed to the outside at said exposing recess.

2. A writing implement comprising:

a barrel cylinder having an ink container for directly storing ink in the rear part thereof;

an ink retainer attached in the front part of said barrel cylinder and having a through-hole provided substantially coaxially in the center thereof, a plurality of circular grooves on the outer periphery thereof for retaining ink and a longitudinal flute communicating between said circular grooves;

a middle core composed of a bundle of fibers and connected to the rear part of a pen point; and an ink conducting core fitted to said through-hole of said ink retainer and having an ink flow passage longitudinally extending thereinside and which communicates the rear part of said middle core with said ink container, so that ink is conducted through said ink flow passage from said ink container to said middle core;

wherein:

the rear end of said through-hole of said ink retainer is formed with a small diameter portion and the rear part of said ink conducting core is formed with an annular groove and a small diameter portion, said small diameter portion of said ink conducting core being positioned within said small diameter portion of said ink retainer so that when a front side wall defining said annular groove abuts a stepped portion defined by said small diameter portion of said through-hole of said ink retainer, backward movement of said ink conducting core is restricted, while when a rear side wall defining said annular groove abuts the rear face of said small diameter portion of said through-hole, forward movement of said ink conducting core is restricted.

3. A writing implement comprising:

a barrel cylinder having an ink container for directly storing ink in the rear part thereof;

an ink retainer attached in the front part of said barrel cylinder and having a through-hole provided substantially coaxially in the center thereof, a plurality of circular grooves on the outer periphery thereof for retaining ink and a longitudinal flute communicating between said circular grooves;

a middle core composed of a bundle of fibers and connected to the rear part of a pen point; and an ink conducting core fitted to said through-hole of said ink retainer and having an ink flow passage longitudinally extending thereinside and which communicates the rear part of said middle core with said ink container, so that ink is conducted through said ink flow passage from said ink container to said middle core;

wherein:

said ink conducting core is formed with an exposing recess for exposing said ink flow passage to the outside of said ink conducting core in the vicinity of the connecting portion of said ink conducting core with said middle core so that air bubbles within said ink flow passage are ejectable to the outside said ink flow passage;

said ink flow passage is an internal passage contained within said ink conducting core and is only exposed to the outside at said exposing recess;

and the rear end of said through-hole of said ink retainer is formed with a small diameter portion and the rear part of said ink conducting core is formed with an annular groove and a small diameter portion, said small diameter portion of said ink conducting core being positioned within said small diameter portion of said ink retainer so that when a front side wall defining said annular groove abuts a stepped portion defined by said small diameter portion of said through-hole of said ink retainer, backward movement of said ink conducting core is restricted, while when a rear side wall defining said annular groove abuts the rear face of said small diameter portion of said through-hole, forward movement of said ink conducting core is restricted.

4. A writing implement as in claim 1, wherein:

said ink flow passage is substantially centrally located within said ink conducting core and has at least one radially outwardly extending portion; and said exposing recess exposes said radially outwardly extending portion.

5. A writing implement as in claim 3, wherein:

said ink flow passage is substantially centrally located within said ink conducting core and has at least one radially outwardly extending portion; and said exposing recess exposes said radially outwardly extending portion.

6. A writing implement as in claim 2, wherein said through-hole of said ink retainer includes radially inwardly projecting parts that engage said ink conducting core forward of said annular groove and small diameter portion.

7. A writing implement as in claim 2, wherein the width in the axial direction of said groove in said ink conducting core is greater than the length in the axial direction of said small diameter portion of said through-hole.

8. A writing implement as in claim 2, wherein said small diameter portion of said through-hole, and said small diameter portion of said ink conducting core are resiliently formed so that said small diameter portion of said ink conducting core can penetrate through said small diameter portion of said through-hole.

9. A writing implement as in claim 3, wherein said through-hole of said ink retainer includes radially inwardly projecting parts that engage said ink conducting core forward of said annular groove and small diameter portion.

10. A writing implement as in claim 3, wherein the width in the axial direction of said groove in said ink conducting core is greater than the length in the axial direction of said small diameter portion of said through-hole.

11. A writing implement as in claim 3, wherein small diameter portion of said through-hole, and said small diameter portion of said ink conducting core are resiliently formed so that said small diameter portion of said ink conducting core can penetrate through said small diameter portion of said through-hole.

* * * * *